US007975451B2

(12) United States Patent
Leopolder et al.

(10) Patent No.: US 7,975,451 B2
(45) Date of Patent: Jul. 12, 2011

(54) BORDERED PANELS, ESPECIALLY FOR WALLS AND CEILINGS

(75) Inventors: Christian Leopolder, Lampertswalde (DE); Maik Moebus, Lampertswalde (DE)

(73) Assignee: Kronoplus Technical AG, Niederteufen (CH)

( * ) Notice: Subject to any disclaimer, the term of this patent is extended or adjusted under 35 U.S.C. 154(b) by 648 days.

(21) Appl. No.: 11/568,829

(22) PCT Filed: Mar. 18, 2005

(86) PCT No.: PCT/EP2005/051273

§ 371 (c)(1),
(2), (4) Date: May 8, 2008

(87) PCT Pub. No.: WO2005/108710

PCT Pub. Date: Nov. 17, 2005

(65) Prior Publication Data

US 2008/0209841 A1 Sep. 4, 2008

(30) Foreign Application Priority Data

May 8, 2004 (DE) ..... 10 2004 022 788
Jun. 19, 2004 (DE) ..... 10 2004 029 879

(51) Int. Cl.
*E04B 2/00* (2006.01)

(52) U.S. Cl. ..... 52/586.1; 52/582.1; 52/592.1; 52/391; 52/571

(58) Field of Classification Search ..... 52/586.1, 52/586.2, 592.1, 592.4, 589.1, 396.1, 582.1, 52/391, 571, 590.2
See application file for complete search history.

(56) References Cited

U.S. PATENT DOCUMENTS

| | | | | |
|---|---|---|---|---|
| 1,809,393 | A * | 6/1931 | Rockwell | 52/99 |
| 1,832,397 | A * | 11/1931 | Hultquist | 52/586.1 |
| 2,027,292 | A * | 1/1936 | Rockwell | 52/396.1 |
| 2,196,807 | A * | 4/1940 | Eckert | 52/464 |
| 2,231,780 | A * | 2/1941 | Swenson | 52/390 |
| 4,599,841 | A | 7/1986 | Haid | |
| 4,644,720 | A * | 2/1987 | Schneider | 52/392 |
| 6,363,677 | B1 * | 4/2002 | Chen et al. | 52/586.1 |
| 6,505,452 | B1 * | 1/2003 | Hannig et al. | 52/582.1 |
| 6,804,926 | B1 * | 10/2004 | Eisermann | 52/592.1 |
| 6,865,855 | B2 * | 3/2005 | Knauseder | 52/592.1 |
| 7,124,549 | B2 * | 10/2006 | Weber | 52/589.1 |
| 7,150,135 | B2 * | 12/2006 | Becker | 52/592.1 |
| 7,377,081 | B2 * | 5/2008 | Ruhdorfer | 52/588.1 |
| 2004/0035080 | A1 | 2/2004 | Becker | |
| 2004/0182036 | A1 * | 9/2004 | Sjoberg et al. | 52/592.1 |

FOREIGN PATENT DOCUMENTS

| | | | |
|---|---|---|---|
| DE | 3837217 | A1 * | 6/1989 |
| DE | 20211263 | U1 * | 12/2002 |

(Continued)

*Primary Examiner* — Brian E Glessner
*Assistant Examiner* — Adriana Figueroa
(74) *Attorney, Agent, or Firm* — Renner, Otto, Boisselle & Sklar, LLP

(57) ABSTRACT

The invention relates to panels (1, 2) that can be interlinked without using glue. In the interlinked state of the panels, a cord (3) runs along the upper side of and between the panels. Said cord widens downwards and rests on the upper side of a spring (5) that forms the coupling element of a panel. The widening is preferably asymmetric. The inventive panels especially allow to provide a wall covering or a ceiling covering in an especially simple manner. The cord consists of a compressible material and prevents water from entering the gap between the panels. The design also compensates for effects related to expansion and shrinkage.

17 Claims, 1 Drawing Sheet

FOREIGN PATENT DOCUMENTS

| | | | |
|---|---|---|---|
| DE | 20319121 | | 6/2004 |
| DE | 20 205 774 | U1 | 9/2009 |
| EP | 0397278 | A1 * | 11/1990 |
| GB | 812671 | | 4/1959 |
| WO | 03/012224 | | 2/2003 |
| WO | 03/087497 | | 10/2003 |

* cited by examiner

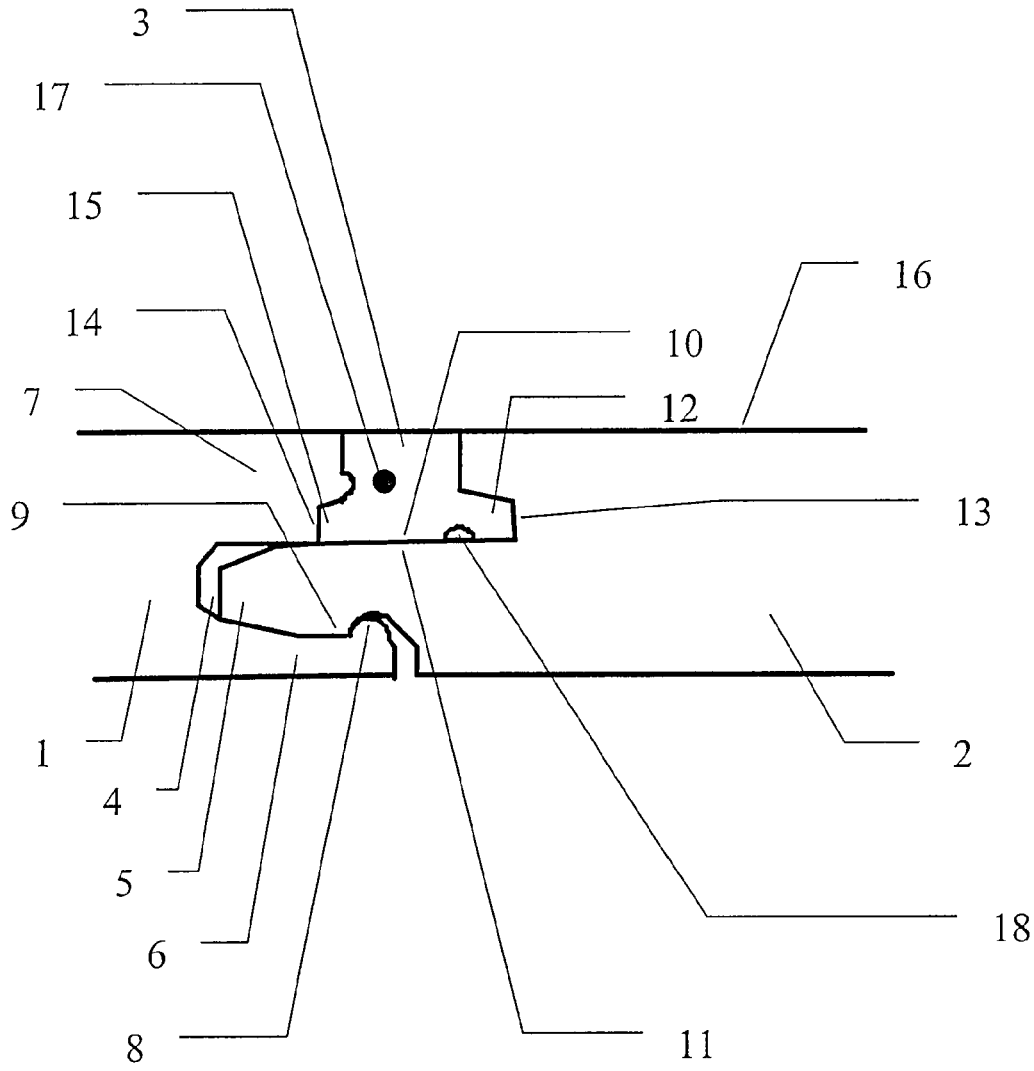
Fig.

BORDERED PANELS, ESPECIALLY FOR WALLS AND CEILINGS

This application is a national phase of International Application No. PCT/EP2005/051273 filed Mar. 18, 2005 and published in the German language.

The invention relates to panels which can be interlinked without using glue. The panels are lined with a cord or bar-like element—denoted in the following as cord. The panels lined with the cord provide, when installed, a covering for a floor, a wall or a ceiling. In the installed condition of the panels, the cord is visible on the surface. Such panels are known from the document DE 202 05 774 U1.

To install the known panels with the cord, either an additional tool has to be used or the cord has to be pushed by force finally in a remaining gap between two panels. The praxis has shown that the installation of such panels with lining is relatively complicated.

Considering this, it is the object of the invention to provide panels with a lining, which can be installed comparatively easily.

The object of the invention is solved by panels with lining, which comprise the features of the first claim. Advantageous embodiments derive from the subclaims. A fast and an easy method for the installation of the panels with lining comprises the feature of the additional independent claim.

The panels are formed such that the same may be interlinked together without using glue. This means that the panels comprise such coupling elements that two panels joint together are coupled by means of a positive fit perpendicular to their common surface as well as parallel to their common surface, and at the same time perpendicular with respect to the common joint. In this condition a gap remains on the surface for the reception of a cord. The coupling elements comprise a tongue which protrudes from a side of a panel. For installation, the cord is arranged on the upper side of the tongue. Subsequently, both panels are coupled with each other. After the coupling, the cord is located in the above-mentioned gap. Praxis has shown that in this way the installation is much easier and faster compared to the state of the art, as was mentioned above.

In order to avoid mistakes during the installation, the lower side of the cord as well as the upper side of the tongue are provided preferably with surfaces adapted to each other. This simplifies the correct arrangement of the cord onto the upper side of the tongue. For example, the tongue comprises in a particularly preferred embodiment a plane, smooth surface, which is parallel to the upper surface of the panel. In this case, the lower side of the cord also forms a plane smooth surface. If the cord is now arranged with its lower side onto the upper side of the tongue, an undesirable twisting of the cord is reliably prevented.

In order to arrange the cord in a reliable manner in the correct position onto the upper side of the tongue, the cord preferably broadens in the direction of its underside. In this way, the contact area of the cord on the upper surface of the tongue is enlarged. This secures a stable position of the cord on the upper surface of the tongue during installation.

In an advantageous embodiment of the invention, the panel provided with the tongue comprises laterally a groove above the tongue. The cord comprises on its side a corresponding lip, which extends into the mentioned groove in installed condition. For installation, the lip of the cord is arranged in the groove, which is provided above the tongue. In this way, the cord is in a further improved way held in a correct position when a first panel is subsequently coupled with a second panel. This is of particular importance, when the panels form a covering for a ceiling or a wall. In this way, it can be avoided that a cord falls down to the floor during installation.

Preferably the lip abuts the lower side of the cord. In this way, the lip forms at the same time a broadening on the lower side of the cord. In this way, first the correct position of the cord on the upper surface of the tongue is secured. On the other hand, the cord can be clamped into the groove which is arranged above the tongue. This allows a particularly simple installation.

Preferably, the groove above the tongue as well as the lip are dimensioned such that the cord is held by frictional connection onto the panel when the lip is arranged in the groove. This is in particular advantageous when the panels form a covering for a wall or a ceiling. In this case, the cord does not undesirably fall down during installation.

The above-mentioned lip of the cord as well as the above-mentioned groove above the tongue further effect, that the cord is held reliably in the gap in installed condition.

In a further advantageous embodiment of the invention, the cord comprises on its side another lip. The panel comprises a groove as a coupling element. Above the groove laterally a recess is provided. The other lip moves into this recess when the panels with the lining are finally installed. In this way, the cord is secured against a detachment or releasing from the gap when the panels are installed with the cord, respectively the lining.

The other lip is also preferably provided on the lower side of the cord, to form a broadening on the lower side.

In an embodiment of the invention, the lip, which protrudes in the groove above the tongue, extends further compared to the other lip, which is arranged in a recess above the groove. The longer lip serves, among others, to hold the cord on the upper side of the tongue during installation. The other lip, however, serves exclusively to hold the cord in the completely installed condition of the covering. The longer lip thus has a double function. To provide sufficient hold during installation, this lip extends comparably long on the side of the cord. Since the other, relatively short lip is only intended to provide a hold in the installed condition, it is not necessary to provide also a long protruding lip on this side. Thus, this other lip may be comparably short. In this way, production costs may be saved.

The upper side of the cord is preferably formed by a smooth plane surface. The height of the cord is dimensioned such that the smooth plane surface is flush with the upper surfaces of the panels. The covering, which is formed by the panels and the cords, thus shows a smooth, plane surface. Therefore, the same is easy to clean. The cords, which line the panels, give the surface an aesthetically advantageous appearance.

In the installed condition, the cord preferably is exactly fitted into the gap or it is in a particular preferred embodiment slightly pressed into the gap. In this way, the critical transition between two panels is very reliably protected against penetrating moisture. Protection is particular reliable when the cords are arranged in the gaps in slightly pressed condition.

Preferably, the cord is made from a compressible material such as rubber or silicon. On the one hand, the handling is improved. On the other hand, a desired press-fit may be realized.

In a preferred embodiment of the invention, the cord is provided inside with a non-elastic thread. In this way, it is advantageously realized that the cord maintains its length during the installation as well as after the installation. Altogether, it is thus realized that the surface of the covering remains free from gaps.

Preferably, the coupling elements of the panels are formed such that the panels have some play in the coupled condition, when there is no cord between both panels. This facilitates in particular the displacement along the common joint, which is regularly necessary during an installation to displace panels into their final position. If the panels are made entirely or essentially from a timber product, the problem arises that the panels extend or shrink depending on the moisture content. In this case in the art regularly undesired gaps appear between the panels on the surface. This formation of gaps is counter-acted by means of the provision of play.

In a further preferred embodiment of the invention, one panel is provided with a tongue as a coupling element, which tapers in the direction of its free end. This facilitates the mounting of the tongue into the groove of the other panel, when two panels are coupled with each other.

In a further advantageous embodiment of the invention, a locking element is provided underneath the tongue of the one panel as a coupling element, which protrudes downwardly. The groove of another panel comprises also a locking element as a coupling element, which is arranged on a lower flank of the groove at the free end thereof and protrudes upwardly. In coupled condition of both panels, the above-mentioned locking elements engage such that a coupling by means of a positive locking in parallel to the upper surface of the two panels is effected. In coupled condition of both panels, groove and tongue effect the coupling by means of a positive lock perpendicular to the common surface of both panels.

The groove of the one panel tapers preferably in the direction of the bottom of the groove. This facilitates the insertion of the tongue of the one panel in the groove of the other panel. Preferably, the lower flank of the groove extends laterally further as compared to the upper flank of the groove. The locking element on the free end of the lower flank can be machined thus more easily. Additionally, there is also more room for the provision of the necessary coupling elements.

It is particularly preferred that the lower flank of the groove extends only so far compared to the upper flank of the groove that the locking element on the free end of the lower flank of the groove is outside of the area, which is overlapped by the upper flank of the groove. The lower flank of the groove thus extends only for the minimum amount. In this way, it is secured that the manufacturing is simple and that there is enough room for the forming of the locking element on the free end of the lower flank. On the other hand, loss of material is minimized. The production is thus particularly cost-effective.

It is particularly preferred that the coupling elements are provided such that two panels may be coupled with each other by shifting the same within one plane. The installation of the panels is thus particularly easy and may be done in a way which is known to the customer. To this end, the material of the panel has to have some kind of elasticity, so that the coupling elements may snap into each other. Timber products such as HDF or MDF are suited for this purpose.

The so-called snap or click connection, which allows an installation by displacement or shifting within one plane, is particularly preferred for the case if the panels form a covering for a wall or a ceiling. The reason for this is that a click connection allows a simple installation. On the other hand, a click connection usually has the disadvantage that panels may also be easily pulled apart. A floor covering is exposed to much stronger mechanical stresses compared to a covering for a wall or a covering for a ceiling. Since the requirements to the stability of the connection between panels are also comparably low for a covering for a ceiling or a wall, such a click connection may be particularly advantageous for a covering for a wall or a ceiling.

The coupling elements are preferably provided on all four sides of the panels. The panels have typically a rectangular surface. The invention relates in particular to laminate panels or parquet panels.

Advantageously, the cord is provided with a groove on its underside which runs along the cord. This groove allows for a certain circulation of air. Differences with regard to moisture may such be balanced better within the coupling element. A warping or distortion of the timber product can thus be advantageously counter-acted.

The surfaces of the panels, which border laterally to the common upper surface of the panels, are preferably arranged perpendicular to the upper surface. Damages to the edges, which border to the upper surfaces of the panels may thus be avoided in a particularly advantageous manner. The surfaces of the cord bordering these surfaces run preferably in parallel to ensure a good contact between the ends and the cord at the visible upper surface.

The FIGURE shows a preferred exemplary embodiment of the invention.

A panel 1 is coupled with a panel 2 by means of a positive lock. There remains a gap between panels at the upper side 16 in which a cord 3 is arranged. Perpendicular to the upper surface 16, the panels are coupled by positive lock through a groove 4 and a tongue 5. A panel 1 with the groove 4 is provided with a lower protruding flank 6, which extends laterally further as compared to the upper flank 7. At the free end of the lower flank 6, a locking element 8 extends upwardly. The lower flank 6 projects in relation to the upper flank 7 only so far as is necessary in order to be able to machine the coupling element 8, without the necessity to move the milling cutter too deep into groove 4. Beneath the tongue 5, a locking element 9 is provided, which extends downwardly. As it is shown in the FIGURE, in coupled condition of two panels, the locking elements 8 and 9 engage each other. Both panels 1 and 2 are thus coupled by means of a positive lock parallel to upper surface 16, as well as perpendicular to the common joint.

The lower protruding flank of the panel 1 with the groove 4 is sufficiently elastic, such that it is possible to connect panel 2 with panel 1 by shifting respectively displacing the same within one plane.

The lower side 10 of the cord 3 runs parallel to upper surface 16. The upper side 11 of the tongue 5 runs also parallel to upper surface 16. This parallel arrangement of the two above-mentioned surfaces allows that during installation the cord 3 may be deposited with its underside 10 onto the upper side 11 of the tongue 5. The cord 3 is provided laterally with a lip 12, which protrudes to a relatively large extent and which is arranged on the underside. In this way, the cord broadens downwardly in the direction of its underside 10. Above the tongue 5, a groove 13 is provided. The lip 12 of the cord 3 reaches into this groove 13. The lip 12 is dimensioned such that the cord 3 is held by means of frictional force or force fit on the upper side 11 of the tongue 5 when lip 12 is moved into groove 13. Above the groove 4, a clearance 14 is provided. A further lip 15 of the cord 3 reaches into this clearance 14 in the installed condition, which lip 15 is arranged opposite to lip 12. Since lip 15 only serves to hold the cord inside the gap during the installed condition, the same protrudes laterally from the underside of the cord 3 for a lesser amount as compared to lip 12. Both lips 12 and 15 broaden the cord 3 downwardly in direction of its underside 10. Thereby the cord 3 rests securely on the surface 11 of tongue 5.

The lips 12, 15 of the cord preferably taper in the direction of their free ends to the outside. Particularly preferred, a groove 13 tapers in the direction of the base of the groove. If two panels are coupled with each other, the same applies for the clearance 14, which in this case also forms a groove together with the upper side of the tongue, which groove tapers in the direction of the groove base. In this way, the installation is further simplified.

If the panels 1 and 2 are coupled with each other without a cord 3 in the remaining gap of the surface, a play remains between the panels and namely parallel to upper surface 16. The provision of this play provides in particular the effect that expansion effects and shrinking effects may be compensated. Expansion and shrinking effects are further compensated by the provision of the cord, which is made entirely or essentially from compressible material.

A thread 17 runs inside the cord 3. The thread 17 is made from a non-expandable material. The thread 17 is enclosed by a compressible material, such as rubber. A groove 18 is located on the underside 10 of the cord 3. The groove 18 runs along the cord 3. This allows for a moisture transport and thus for a balancing of the moisture inside of the timber material, of which the panels are essentially composed.

Currently, HDF is preferred as timber material. The base plate, which serves as a carrier, is made therefrom. A décor above the base plate is formed either by means of a décor paper together with an abrasion resistant layer or by a layer, which is essentially formed from wood. Underneath the base plate, usually a counter-layer, e.g. in the form of paper, is provided. Underneath the counter-layer, a sound insulating layer may be provided.

Currently, such a panel has a thickness of typically 5-15 mm. The upper side of the cord typically has a width of 1-10 mm.

Above the clearance 14 of the panel 1 as well as above the lip 15 of the cord 3, a further clearance may be located next to cord 3, as well as a protruding lip of the panel 1, which further provides for a secure hold of the cord inside of the gap.

Both panels 1 and 2 may also be coupled with each other by means of a pivoting motion. For this purpose, panel 2 is held in an inclined angle during the installation, such that the tongue 5 moves at an angle into groove 4. At the same time, the cord 3 is located on the surface of tongue 5. Lip 12 is located in groove 13 above the tongue. Panel 2 will now be pivoted downwardly and in this way coupled with panel 1.

However, it is simpler to first lay the cord 3 onto the upper side of tongue 5 and to move the lip 12 into the groove 13. Subsequently, panel 2 is moved in one plane in the direction of panel 1, until tongue 5 is located in groove 4 and the coupling elements 8 and 9 engage each other.

The embodiment shown in the FIGURE serves particularly as a covering for a wall or a ceiling.

The invention claimed is:

1. A panel system comprising at least one cord and at least two panels having coupling elements which are formed such that the panels may be coupled with each other by positive locking without the application of glue, the panels in coupled condition forming at upper surfaces thereof between adjacent edges thereof a gap for reception of the cord, the cord broadening in width going downwardly away from the upper surfaces of the panels and having a laterally protruding lip, at least one of the panels having in the adjacent edge thereof a groove for reception of the laterally protruding lip, and the laterally protruding lip and groove being correspondingly dimensioned such that the laterally protruding lip is held in the groove by friction when positioned in the groove, whereby the cord will be held to said one panel during coupling of the panels, and wherein the cord has a first side at which the laterally projecting lip is located, and the cord has another laterally projecting lip located at a second side opposite the first side, and the one lip at the first side projects laterally further from a body portion of the cord than the lip at the second side.

2. A panel system according to claim 1, whereby the gap at the upper surfaces of the panels has a width of 1 mm to 10 mm.

3. A panel system according to claim 1, wherein in the coupled condition of two panels the gap extends downwardly to a tongue formed on one of the panels.

4. A panel system according to claim 1, wherein one of the panels has a coupling groove formed between upper and lower flanks, and the lower flank projects laterally beyond the upper flank.

5. A panel system according to claim 4, wherein the lower flank is provided with a locking element at its free end, which locking element projects upwardly.

6. A panel system according to claim 5, wherein the lower flank projects beyond the upper flank.

7. A panel system according to claim 1, wherein said one panel is provided with a laterally projecting tongue and the groove is located above the laterally projecting tongue.

8. A panel system according to claim 1, wherein said one panel is provided a laterally projecting tongue and the tongue has at an underside thereof a locking element that projects downwardly.

9. A panel system according to claim 1, wherein the coupling elements are formed such that a play exists between panels when coupled with each other if the cord is not located in the gap.

10. A panel system according to claim 1, wherein the cord has a groove on its underside.

11. A panel system according to claim 1, wherein the cord is made fully or at least predominantly from compressible material.

12. A panel system according to claim 1, wherein the cord comprises a thread which is made from a non-extendible material.

13. A covering for a wall or a ceiling, built from panels and cords according to the system of claim 1.

14. A method of assembling the panel system of claim 1 for the provision of a covering, the method comprising the steps:

mounting the cord onto the upper side of a tongue of a first one of the panels, by moving the laterally projecting lip at the first side of the cord into the groove of the first one of the panels with a force fit such that the lip will be held in the groove, whereby the cord is arranged above the tongue and held to the first one of the panels; and displacing the panel with the tongue in the direction of a second one of the panels, which is laterally provided with a coupling groove, until locking elements of the first and second panels engage each other and the first and second panels are coupled with and positively locked to each other.

15. A method according to claim 14, whereby a covering for a wall or a ceiling is provided.

16. A panel system according to claim 11, wherein the cord is made fully or at least predominantly from rubber or silicone material.

17. A panel system according to claim 12, wherein the thread is made of plastic.

* * * * *